US006356720B1

(12) United States Patent
Yoshioka

(10) Patent No.: US 6,356,720 B1
(45) Date of Patent: Mar. 12, 2002

(54) IMAGE FORMING APPARATUS FOR INSURING PROPER IMAGE TRANSFER

(75) Inventor: Toru Yoshioka, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 09/577,133

(22) Filed: May 24, 2000

(30) Foreign Application Priority Data

May 24, 1999 (JP) ..... 11-143418

(51) Int. Cl.[7] ..... G03G 15/16
(52) U.S. Cl. ..... 399/66; 399/44; 399/45
(58) Field of Search ..... 399/44, 45, 66, 399/310, 311

(56) References Cited

U.S. PATENT DOCUMENTS 5,012,293 A * 4/1991 Aldrich et al. ..... 399/66
5,546,172 A * 8/1996 Seto ..... 399/311

FOREIGN PATENT DOCUMENTS

| | | | |
|---|---|---|---|
| JP | 6-19334 | * | 1/1994 |
| JP | A7239607 | | 9/1995 |
| JP | 9-127769 | * | 5/1997 |
| JP | A1078712 | | 3/1998 |

* cited by examiner

*Primary Examiner*—Joan Pendegrass

(57) ABSTRACT

An image forming apparatus prevents the current of a transfer memory by providing a sufficient margin to accommodate any variation in feeding and timing without limiting the diameter of a photoreceptor. A transfer current controlling unit is included for controlling the transfer current applied to the transfer device and for controlling a TC high-voltage source control unit so that a transfer high-voltage source of the transfer device performs a stepwise current application in the raising process of a transfer output.

8 Claims, 11 Drawing Sheets

IMAGE FORMING APPARATUS FOR INSURING PROPER IMAGE TRANSFER

BACKGROUND OF THE INVENTION

1. Field of the Invention

The present invention relates to an electrophotographic image forming apparatus such as copying machines, photoprinters and facsimile apparatuses employing an electrophotographic system.

2. Description of the Related Art

In conventional image forming apparatuses using an electrophotographic system, in the case of utilizing a transfer device of a corona discharge system, a transfer current is applied with appropriate timing to a recording material which has been fed to a transfer position between a photoreceptor and the transfer device, whereby a toner image on the photoreceptor is transferred onto the recording material.

However, feeding variation of recording material or timing variation of transfer signal causes application of the transfer current before arrival of a recording material at the transfer position between the photoreceptor and the transfer device, with the result that the transfer current with a polarity opposite to the electrostatic charge in forming a latent image is directly applied to the photoreceptor, which causes an image defect of "transfer memory". This is because during printing on a sheet of the recording material, the photoreceptor rotates more than one time for printing one sheet of recording material.

Japanese Unexamined Patent Publication JP-A 7-239607 (1995) has proposed an image forming apparatus wherein damage from a transfer drum in a transfer process is reduced by extending the diameter of an image carrying member to form a quality image. The image forming apparatus is hereinafter referred to as "prior art 1".

Japanese Unexamined Patent Publication JP-A 10-78712 (1998) has proposed an image forming apparatus wherein by applying to a transfer roller which is always in contact with a photoreceptor drum, a high level voltage and a low level voltage separately, responsive to pass and non-pass of the recording material at the application of the voltage, a transfer memory inhibiting effect is provided (hereinafter referred to as "prior art 2").

With respect to the prior art 1, however, by extending the diameter of the photoreceptor, the overall apparatus will be bigger, whereby the transfer memory occurs due to an unavoidable feeding variation of recording material or the like. Further, extending the diameter of the photoreceptor goes against the downsizing of the apparatus and cost-lowering trend. Furthermore, a non-contact transfer device having a corona discharge system, does not have a feeding accuracy like a contact-type transfer roller, namely, the feeding accuracy for accurately feeding the recording material to the transfer point. Thus, the effect of unavoidable feeding variation and transfer the signal timing variation is very severe.

With the prior art 2, the voltage application timing in the high-level state is made earlier by a rise time of a transfer bias power source so that the front edge of the recording material reaches the transfer point at a time when a transfer output is sufficiently raised. In this art, however, a feeding variation of the recording material is not considered at all. Thus, even if a few variations are caused, the transfer memory occurs.

SUMMARY OF THE INVENTION

Hence, an object of the present invention is to provide an image forming apparatus which prevents the occurrence of the transfer memory by ensuring a sufficient margin against variation without limiting the diameter of the photoreceptor.

The present invention provides an image forming apparatus including an image carrier; and an electrostatic charging device for causing the image carrier to be electrostatically charged. An exposure device is further included for forming an electrostatic latent image by exposing the electrostatically charged image carrier to a light. A developing device then develops the formed electrostatic latent image with toner. Further, a transfer device is included for transferring a toner image formed by development, to a recording material which is in contact with a peripheral surface of the image carrier, by generating the corona discharge directed to the recording material. Finally, a current controller controls a transfer current for corona discharge applied to the transfer device so as to be applied stepwise to the transfer device at a time of start-up of the transfer.

According to the invention, the stepwise current application to the transfer device makes it possible to prevent the transfer memory from being formed on the photoreceptor as the image carrier, and to transfer an image properly.

In addition, in the invention, it is preferable that the current controller controls the transfer current so as to be applied stepwise, by adjusting on and off time durations of a current applying control signal composed of on and off signals. As such, a control system of the apparatus can be simplified.

According to the invention, a control system of the apparatus can be simplified.

Furthermore, in the invention, it is preferable that the current controller controls the transfer current so as to be applied stepwise by using a switching circuit system to adjust an amount of time of application of the transfer current to the transfer device. As such, finer and complicated control is possible.

Furthermore, in the invention, it is preferable that the current controller performs the stepwise application of the transfer current to the transfer device in a process for raising a current value to a predetermined level at which a constant-current control is possible and a number of transfer current steps is one or two. By defining the number of transfer current steps as one or two, no transfer memory occurs and a favorable edge transfer performance can be maintained.

Furthermore, in the invention, it is preferable that the current controller performs the stepwise application of the transfer current to the transfer device in a process for raising a current value to a predetermined level at which constant-current control is possible, and a duration of the process is 100 to 120 ms. As such, no transfer memory occurs, and the favorable edge transfer performance can be maintained.

Furthermore, in the invention, it is preferable that the current controller performs the stepwise application of the transfer device in the process for raising a current value to a predetermined level at which constant-current control is possible, and the stepwise transfer current application is performed when a current value is within a range of 40% to 50% of the predetermined level. As such, no transfer memory occurs, and a favorable edge transfer performance can be maintained.

Furthermore, in the invention, it is preferable that the image forming apparatus further includes a humidity sensor for sensing a humidity of an operational environment, wherein the current controller varies stepwise applying conditions of the transfer current based on a result sensed by the humidity sensor. As such, stabilized transfer performance can be maintained without being influenced by environmental conditions, particularly humidity.

Furthermore, in the invention, it is preferable that the image forming apparatus further includes a thickness sensor for sensing a thickness of the recording material, wherein the current controller varies stepwise applying conditions of the transfer current based on a result sensed by the thickness sensor. As such, stabilized transfer performance can be maintained without being subjected to the thickness of the recording material.

Furthermore, in the invention, it is preferably that the transfer device is provided with a corona discharge electrode composed of a wire electrode. As such, a transfer device having a simplified structure and good volume production can be provided.

Furthermore, in the invention, it is preferable that the transfer device is provided with a corona discharge electrode composed of a serrated electrode. As such, the amount of generated ozone can be reduced. Thus, an environment-friendly transfer device can be provided in comparison with the case of using the wire electrode.

BRIEF DESCRIPTION OF THE DRAWINGS

Other and further objects, features, and advantages of the invention will be more explicit from the following detailed description taken with reference to the drawings wherein:

FIGS. 2Ato 2D are schematic views explaining transfer current application methods, wherein FIG. 2A is a graphic diagram showing a rise of the transfer current according to the method of the present invention as compared with the method according to a conventional method;

FIG. 2B is a signal waveform diagram showing the on and off timing of a control signal according to the conventional current application method;

FIG. 2C is a signal waveform diagram showing on-signal timing and off-signal timing using a current application control signal (composed of on and off signals); and FIG. 2D is a signal waveform diagram showing the relationship between an application amount of the transfer current and-the application time of the transfer current employing a switching circuit system;

DETAILED DESCRIPTION OF THE PREFERRED EMBODIMENTS

Figure 1A:
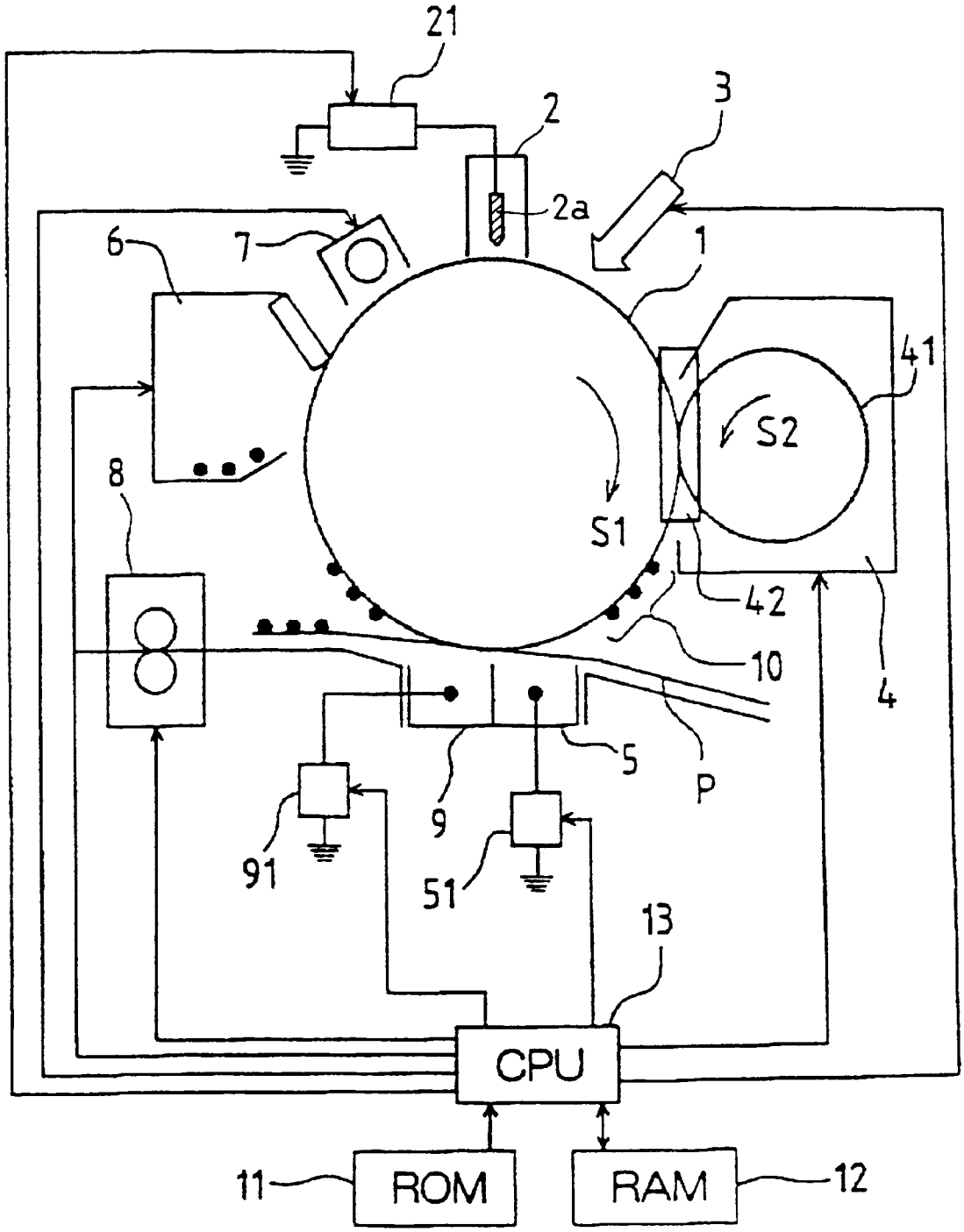
FIG. 1*a* is a schematic view similar to FIG. 1, illustrating a serrated electrode in the electrostatic charging device.

Now referring to the drawings, preferred embodiments of the invention are described below.

FIG. 1 is a schematic view showing a concrete example of the image forming apparatus employing a two-component development system according to the invention.

This image forming apparatus performs the following processes: electrostatic charging, exposure, development, transfer, cleaning, fusing, and eliminating. Around the photoreceptor drum 1 are arranged an electrostatic charging device 2 with a charging high-voltage source 21, an exposure device 3, a developing device 4, a transfer device 5 with a transfer high-voltage power source 51, a peeling device 9 with a peeling high-voltage power source 91, a cleaning device 6, an eliminator 7, and a fusing device 8 causing toner on the recording material P having passed the transfer device 5 to be fused and fixed. Additionally, the apparatus is provided with a CPU 13 connecting a ROM 11 and RAM 12, and the CPU 13 outputs control signals to a control unit, which is not shown in drawings, of each device 2 to 9 in accordance with a program stored in the ROM 11.

The photoreceptor drum 1 is disposed rotatably in the direction indicated by arrow Si in the drawing. The surface (periphery) of the photoreceptor drum 1 is uniformly electrostatically charged to a predetermined charge level by a corona charger or contact roller charger as the electric charging device 2 and carries an electrostatic latent image by forming a predetermined electrostatic latent image potential with the exposure device 3.

The photoreceptor drum 1, which is not shown in the drawings, includes a metallic or resinous conductive base, an undercoated layer formed on the conductive base, and a photosensitive layer formed on the undercoated layer. The photosensitive layer is composed of a relatively thin carrier generation layer (CGL) formed on the undercoated layer, and a relatively thin carrier transport later (CTL) formed on an outermost layer having polycarbonate as the main component.

Carriers are generated in the carrier generation layer by light exposure. The charges on the photoreceptor drum 1 are offset by the carriers, and the electrostatic latent image potential is formed.

The electrostatic latent image carried by the photoreceptor drum 1 is conveyed to a developing region 42 in contact with a developer carrier 41 of the developing device 4 by rotating the photoreceptor drum 1. The developer carrier 41 comes into pressure contact with the photoreceptor drum 1 and rotates according to a rotation of the photoreceptor drum 1. In other words, the developer carrier rotates in the S2 direction indicated by an arrow, which is opposite to the Si direction as the rotation direction of the photoreceptor drum 1. In this way, toner carried by the developer carrier 41 is transferred and adhered according to the electrostatic latent image of the photoreceptor drum 1. Thus, the electrostatic latent image because tangible and is developed. To the developer carrier 41, which is not shown in the drawings, is applied a predetermined bias voltage by a power source.

After development, toner 10 adhered to the photoreceptor drum 1 is conveyed to the predetermined transfer region. To the transfer region, the recording material P such as paper has been fed by a sheet feeder, which is not shown in the drawings, so as to contact with the photoreceptor drum 1 in synchronization with the tone image. The transfer device 5 disposed in the transfer region may be a contact roller type or a charger type having the transfer high-voltage source 51 and which apply to the photoreceptor drum 1 a voltage having a polarity on a side transferred the toner 10. Thus, the toner 10 migrates to the recording material P, and the toner image can be transferred.

Subsequently, the recording material P is separated from the photoreceptor drum 1 by the peeling device 9, and the toner on the separated recording material P is fused by the fusing device 8. For example, the recording material P is fused by heat and ejected to the outside of the apparatus.

After transfer of the toner image to the recording material P, the surface of the photoreceptor drum 1 is cleaned by the cleaning device 6, and thereafter residual charges on the surface of the photoreceptor drum 1 are eliminated by the eliminator 7, so that the surface of the photoreceptor drum 1 is electrically initialized. As eliminator 7, an optical eliminator lamp, a contact-type eliminator or the like is used.

A transfer current applying method to the transfer device 5 in the raising process of a transfer output in the image forming apparatus thus constructed is described in the following exemplary embodiments.

First embodiment

In this embodiment, as the transfer device 5, the corona discharge system is used, and as the electrode, a tungsten wire is used. Advantageously, such a wire electrode has a simple structure and good volume production. This embodiment employs, as stepwise transfer current applying method, a method for adjusting the durations of the on-time and off-time by using current application controlling signals (on/off signals), and a method for adjusting the transfer current application amount and the application time by using a switching circuit system.

Figure 2A:
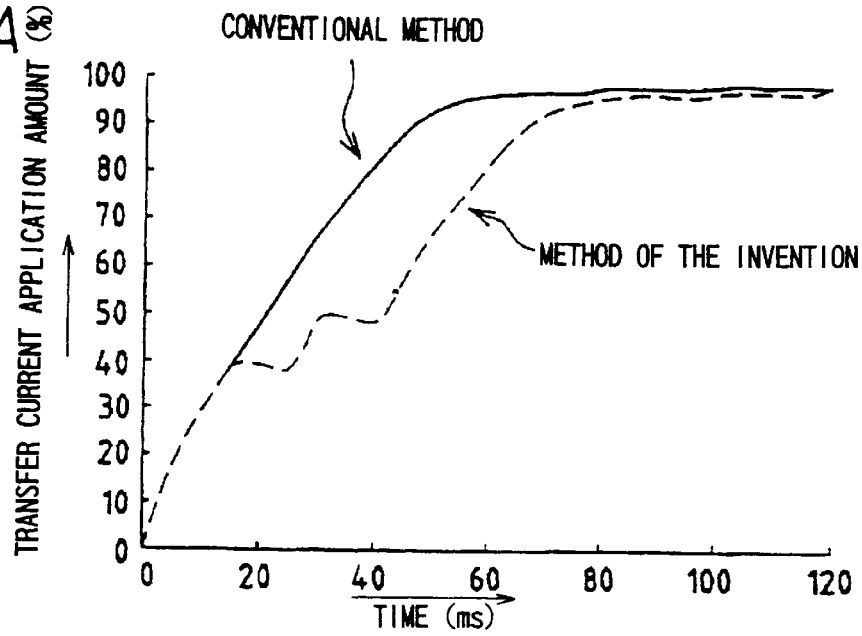
Figure 2B:
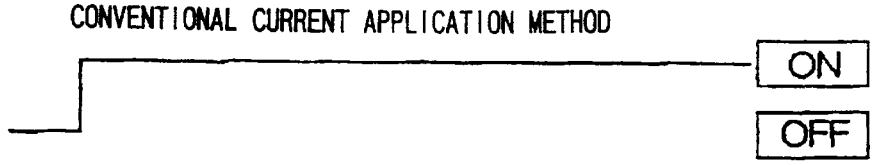
FIG. 2B PRIOR ART
Figure 2C:
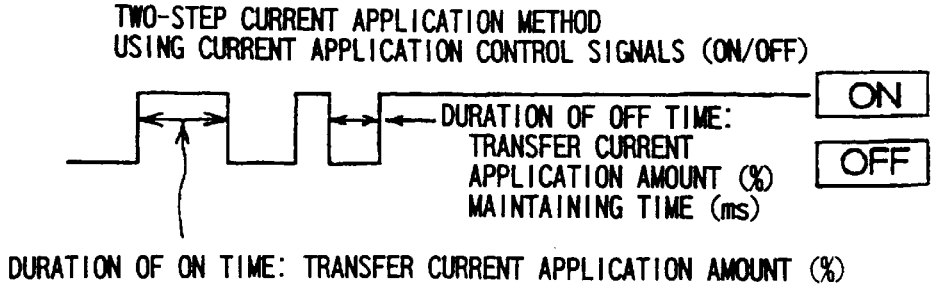
Figure 2D:
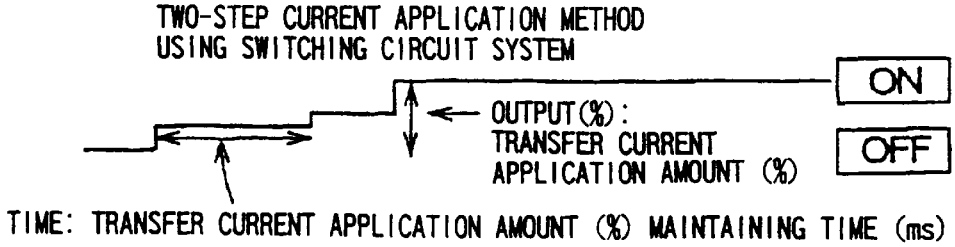

FIGS. 2A to 2D are schematic views explaining transfer current application methods, wherein FIG. 2A is a graphic diagram showing a rise of the transfer current according to the method of the present invention as compared with the method according to a conventional method; FIG. 2B is a signal waveform diagram showing the on/off timing of a control signal according to the conventional current application method; FIG. 2C is a signal waveform diagram showing on-signal timing and off-signal timing using a current application control signal (composed of on/off signals); and FIG. 2D is a signal waveform diagram showing the relationship between an application amount of the transfer current and the application time of the transfer current employing a switching circuit system.

While the transfer current is conventionally raised in such a manner to draw a smooth curve by using an on/off timing control signal as shown in FIG. 2B, the transfer current is raised stepwise in the invention by entering a control signals as shown in FIG. 2C or FIG. 2D, thereby reducing the occurrence of the transfer memory.

In FIG. 2C, the durations of the on-time and off-time of the current application control signal composed of an on signal and off signal are adjusted in order to perform a stepwise current application. Alternatively, in FIG. 2D, the transfer current application amount (output) and the current application time (durations of maintaining the current application) are adjusted to perform a stepwise current application.

Table 1 shows the results of the occurrence of the transfer memory and the edge transfer performance by using the current application method shown in FIG. 2C, in which the transfer current is applied in seven different ways by varying the on and off time durations in a current raising process. Note that the test was conducted under environmental conditions: normal temperature and normal humidity (humidity: 50%). The printing performance was evaluated by continuously printing 100 sheets, taking feeding variation of recording material and timing variation of transfer signal into consideration.

TABLE 1

| HUMIDITY | TRANSFER CURRENT APPLICATION METHOD USED IN CURRENT RAISING PROCESS | TRANSFER MEMORY | EDGE TRANSFER PERFORMANCE | CURRENT APPLICATION CONTROL SIGNAL (ON/OFF TIME (ms)) ON | OFF | ON | OFF | ON |
|---|---|---|---|---|---|---|---|---|
| 50% | A (CONVENTIONAL METHOD) | ×× | ◎ | FULL APPLICATION | | | 10 | FULL |
| | B | × | ◎ | 30 | 20 | FULL APPLICATION | | |
| | C | ○ | ◎ | 20 | 20 | FULL APPLICATION | | |
| | D | ◎ | ◎ | 15 | 10 | 5 | | |
| | E | ◎ | ○ | 15 | 20 | FULL APPLICATION | | |
| | F | ◎ | ○ Δ | 10 | 20 | FULL APPLICATION | | |
| | G | ◎ | × | 5 | 20 | FULL APPLICATION | | |

The conventional method A exhibits a good edge transfer performance, but its transfer performance decreases due to the occurrence of the transfer memory. Likewise, also current application method B raising current stepwise exhibits a good edge transfer performance, but its transfer performance, decreases due to the occurrence of the transfer memory. In contrast, current application methods C, D and E are found to have exhibited substantially satisfactory performance in terms of the transfer memory and the edge transfer performance. Current application methods F and G exhibit bad edge transfer performances, though the transfer memory does not occur, and its transfer performance decreases.

Figure 3:
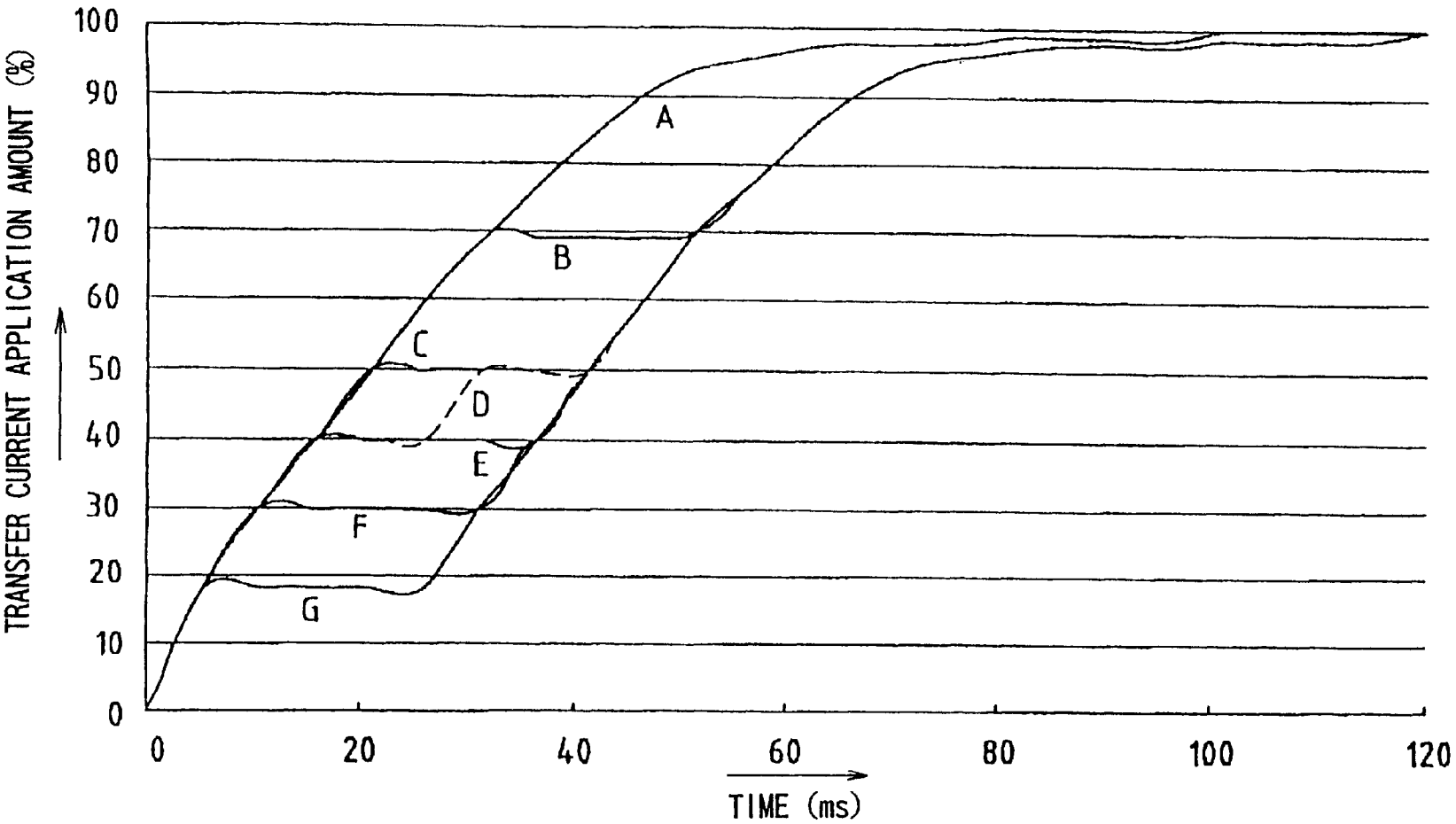
FIG. 3 is a graph showing the relationship between the transfer current application amount and the current raising time based on a result of Table 1.

The relationship between the transfer current application amount and the current raising time on the basis of results of Table 1 is graphically shown in FIG. 3.

According to the results, the transfer memory does not occur when the transfer current application amount is 50% or less, while the edge transfer performance is degraded when the transfer current application amount is 40% or less.

Further, as shown in the application method D, by providing a step when the transfer current application amount is within a range of 40% to 50%, a sufficient margin can be secured to accommodate feeding variation of recording material P and timing variation of transfer signal. Specifically, with the conventional transfer current application method, the time period for which the transfer current application amount is within the favorable range of 40% to 50% is only 5 ms, while the transfer current application method of the invention provides a margin of 20 ms that is four times as long as the margin provided by the conventional method. It should be noted that the number of steps provided in the stepwise current raising method is suitably one or two as shown in FIG. 2A. In this case the current raising time is 120 ms.

Second embodiment

In general, the transfer performance of an image forming apparatus is greatly effected by environmental conditions, particularly humidity. To overcome this inconvenience, a second embodiment proposes a method for constantly maintaining an optimal transfer performance by sensing and judging the environmental conditions.

In the image forming apparatus shown in FIG. 1, a humidity sensing device as an environmental condition sensor is provided. On the basis of the results sensed by this humidity sensing device, the transfer current application method in the raising process of the transfer current is controlled.

Figure 4:
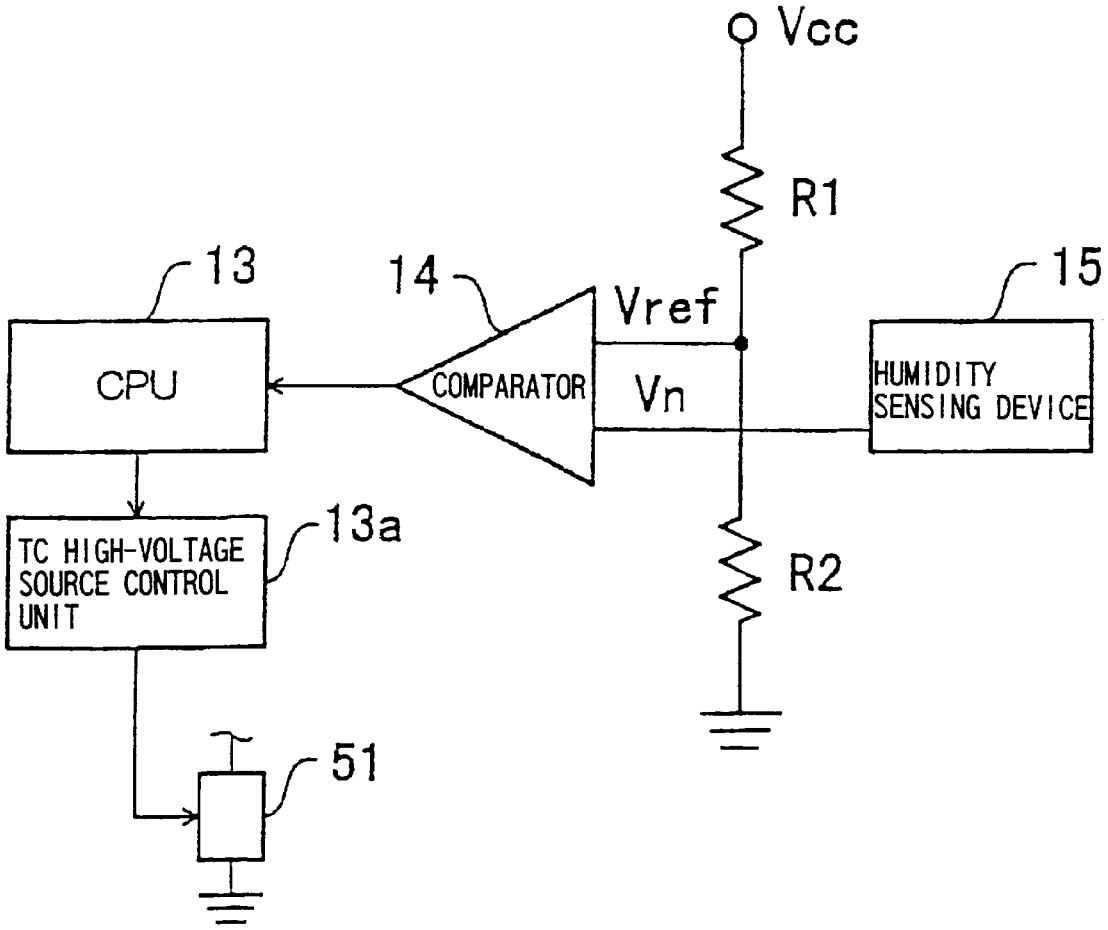
FIG. 4 is a basic circuit block diagram for realizing a control method of a second embodiment.

FIG. 4 is a basic circuit block diagram for realizing a control method of a second embodiment.

Specifically, an output terminal of a humidity sensing device 15 is connected to one of input terminals of a comparator 14. To the other input terminal of the comparator 14, a comparative reference voltage Vref resulting from division of a source voltage Vcc by resistors R1 and R2 is applied. The output of the comparator 14 is inputted to CPU 13. The humidity sensing device 15 transforms the sensed humidity into a voltage Vn and inputs it to the comparator 14.

The comparator 14 compares both voltage values with each other. When the humidity sensed by the humidity sensing device 15 is lower than a predetermined humidity, namely Vref>Vn, the comparator 14 outputs a signal L. When the humidity sensed by the humidity sensing device 15 is not lower than the predetermined humidity, namely Vref≦n, the comparator 14 outputs a signal H.

The CPU 13 outputs a control signal based on the inputted signal to a TC high-voltage source control unit 13*a* so as to control the transfer output of the transfer high-voltage source 51.

Table 2 and 3 show results of tests of occurrence of transfer memory and edge transfer performance in which a current application method as shown in FIG. 2C is used under sensing and controlling humidity with a circuit block as shown in FIG. 4, of which Table 2 relates to a test in which four transfer current application methods of different on/off time duration in the raising process (Table 2) are used and Table 3 to a test in which four transfer current application methods of constant on/off time duration are used.

TABLE 2

ALTERED DURATION OF CURRENT APPLICATION CONTROL SIGNAL

| HUMIDITY | TRANSFER CURRENT APPLICATION METHOD USED IN CURRENT RAISING PROCESS | TRANSFER MEMORY | EDGE TRANSFER PERFORMANCE | CURRENT APPLICATION CONTROL SIGNAL (ON/OFF TIME (ms)) ON | OFF | ON | OFF | ON |
|---|---|---|---|---|---|---|---|---|
| 85% | A (CONVENTIONAL METHOD) | ×× | ◎ | FULL APPLICATION | | | 10 | FULL APPLICATION |
| | C | ○ | ◎ | 15 | 20 | FULL APPLICATION | | |
| | D | ◎ | ◎ | 10 | 10 | 5 | | |
| | E | ◎ | ○ | 10 | 20 | FULL APPLICATION | | |
| 15% | A (CONVENTIONAL METHOD) | ×× | ◎ | FULL APPLICATION | | | 10 | FULL APPLICATION |
| | C | ○ | ◎ | 25 | 20 | FULL APPLICATION | | |
| | D | ◎ | ◎ | 20 | 10 | 5 | | |
| | E | ◎ | ○ | 20 | 20 | FULL APPLICATION | | |

↑ ALTERED PORTION

TABLE 3

DURATION MAINTAINED OF CURRENT APPLICATION CONTROL SIGNAL (AS BEFORE ALTERATION)

| HUMIDITY | TRANSFER CURRENT APPLICATION METHOD USED IN CURRENT RAISING PROCESS | TRANSFER MEMORY | EDGE TRANSFER PERFORMANCE | CURRENT APPLICATION CONTROL SIGNAL (ON/OFF TIME (ms)) ON | OFF | ON | OFF | ON |
|---|---|---|---|---|---|---|---|---|
| 85% | A (CONVENTIONAL METHOD) | XXX | ◎ | SAME AS IN EXAMPLE 1/TABLE 1. | | | | |
| | C | ○Δ | ◎ | | | | | |
| | D | ○ | ◎ | | | | | |
| | E | ○ | ◎ | | | | | |

TABLE 3-continued

| | DURATION MAINTAINED OF CURRENT APPLICATION CONTROL SIGNAL (AS BEFORE ALTERATION) | | | | | | | |
|---|---|---|---|---|---|---|---|---|
| | TRANSFER CURRENT APPLICATION METHOD USED IN CURRENT RAISING | TRANSFER | EDGE TRANSFER | CURRENT APPLICATION CONTROL SIGNAL (ON/OFF TIME (ms)) | | | | |
| HUMIDITY | PROCESS | MEMORY | PERFORMANCE | ON | OFF | ON | OFF | ON |
| 15% | A (CONVENTIONAL METHOD) | X | ◎ | | | | | |
| | C | ◎ | ○ | | | | | |
| | D | ◎ | ○ | | | | | |
| | E | ◎ | ○Δ | | | | | |

Figure 5:
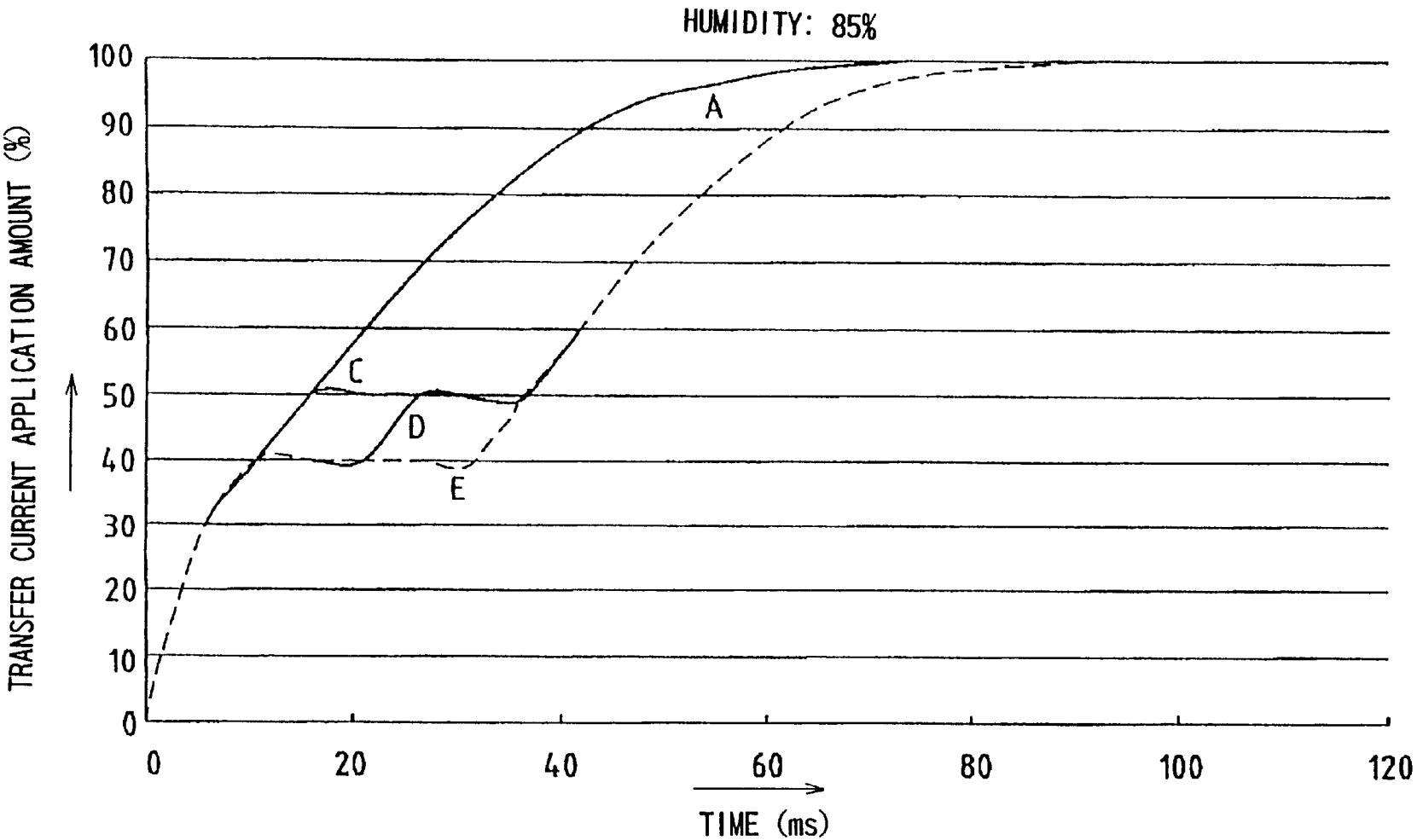
FIG. 5 is a graph showing the relationship between the transfer current application amount and the current raising time.
Figure 6:
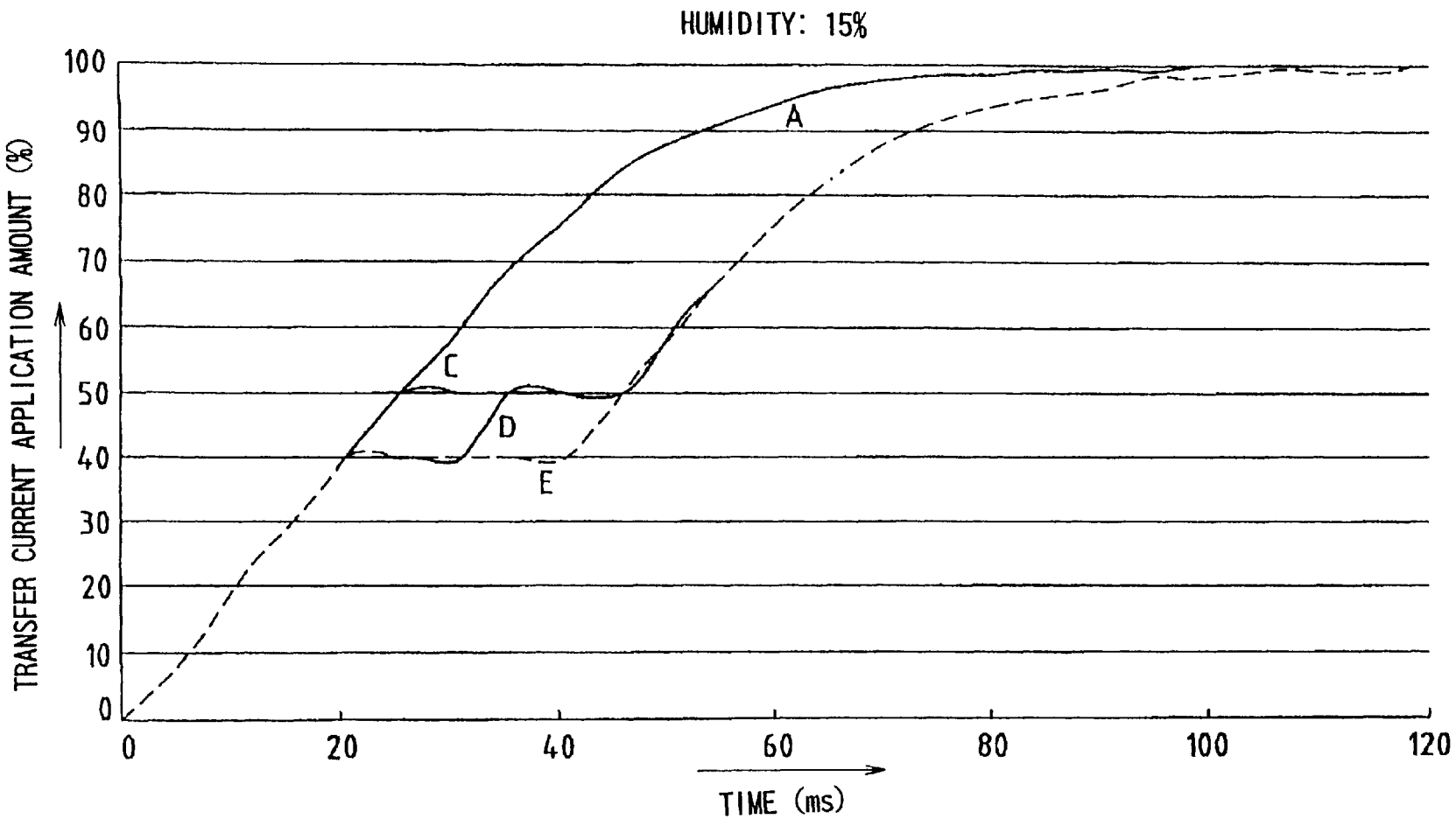
FIG. 6 is a graph showing the relationship between the transfer current application amount and the current raising time.

The relationship between the transfer current application amount and the current raising time is shown in FIGS. 5 and 6. Note that the same evaluation method as in the first embodiment is employed.

As can be understood from these results, in high humidity (85%)and low humidity (15%), the optimal transfer current application amount per unit time is different from each other.

Further, as shown in Table 2, under each humidity condition, a step can be provided when the transfer current application amount is within an optimal range of 40% to 50% by altering the durations of the current application control signals by 5 ms.

From the above, it is found that by controlling a time of the current application control signals in a high humidity mode when the humidity is 65% or higher, in a normal mode when the humidity is between 25% and 65%, or in a low humidity mode when the humidity is 25% or lower, satisfactory results under any environmental condition can be obtained.

Figure 7:
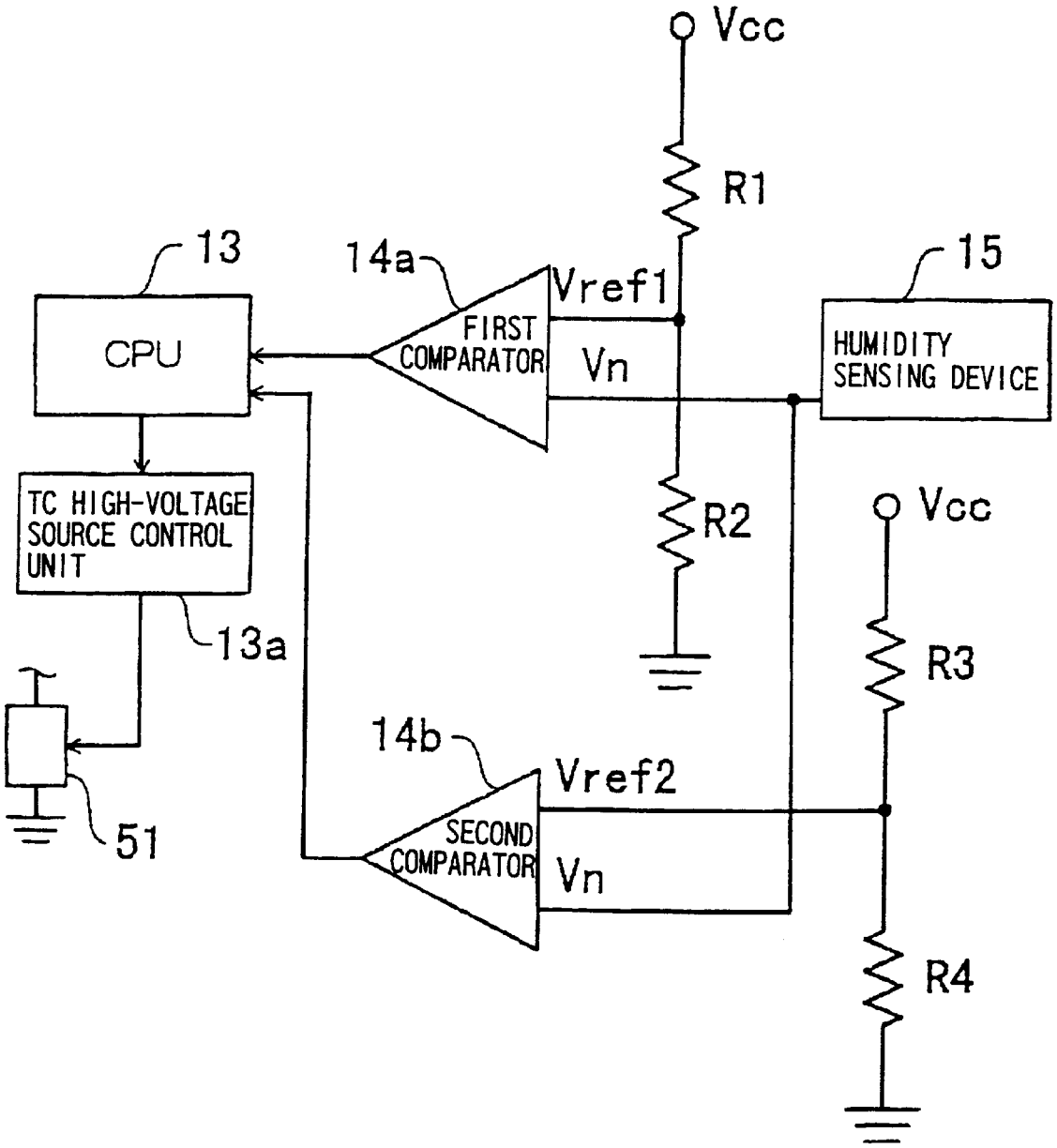
FIG. 7 is a more concrete circuit block diagram for realizing the control method of the second embodiment.

FIG. 7 shows a circuit block diagram for applying current application control signals from the TC high-voltage source control unit 13*a* to the transfer device 5 in the three different modes (i.e., high humidity mode, normal mode and low humidity mode).

Specifically, an output terminal of the humidity sensing device 15 is connected to one of input terminals of a first comparator 14*a* and second comparator 14*b,* respectively. To the other input terminal of the first comparator 14*a,* a comparative reference voltage Vref1 resulting from division of a source voltage Vcc by resistors R1 and R2 is applied. Similarly, to the other input terminal of the second comparator 14*b,* a comparative reference voltage Vref2 resulting from division of a source voltage Vcc by resistors R3 and R4 is applied. The outputs of these comparators 14*a* and 14*b* are inputted to CPU 13. The humidity sensing device 15 transforms the sensed humidity into a voltage Vn and inputs it to the comparators 14*a* and. 14*b,* respectively.

The first comparator 14*a* compares both voltage values with each other. When the humidity sensed by the humidity sensing device 15 is lower than a predetermined humidity (25%), namely Vref1>Vn, the first comparator 14*a* outputs a signal L. When the humidity sensed by the humidity sensing device 15 is not lower than the predetermined humidity (25%), namely Vref1≦Vn, the first comparator 14*a* outputs a signal H. On the other hand, the second comparator 14*b* compares the two inputted voltage values with each other. When the humidity sensed by the humidity sensing device 15 is lower than a predetermined humidity (65%), namely Vref2>Vn, the second comparator 14*b* outputs a signal L. When the humidity sensed by the humidity sensing device 15 is not lower than the predetermined humidity (65%), namely Vref2≦Vn, the second comparator 14*b* outputs a signal L. When the humidity sensed by the humidity sensing device 15 is not lower than the predetermined humidity (65%), namely Vref2≦Vn, the second comparator 14*b* outputs a signal H.

The CPU 13 outputs a control signal based on the signals to the TC high-voltage source control unit 13*a.*

Figure 8:
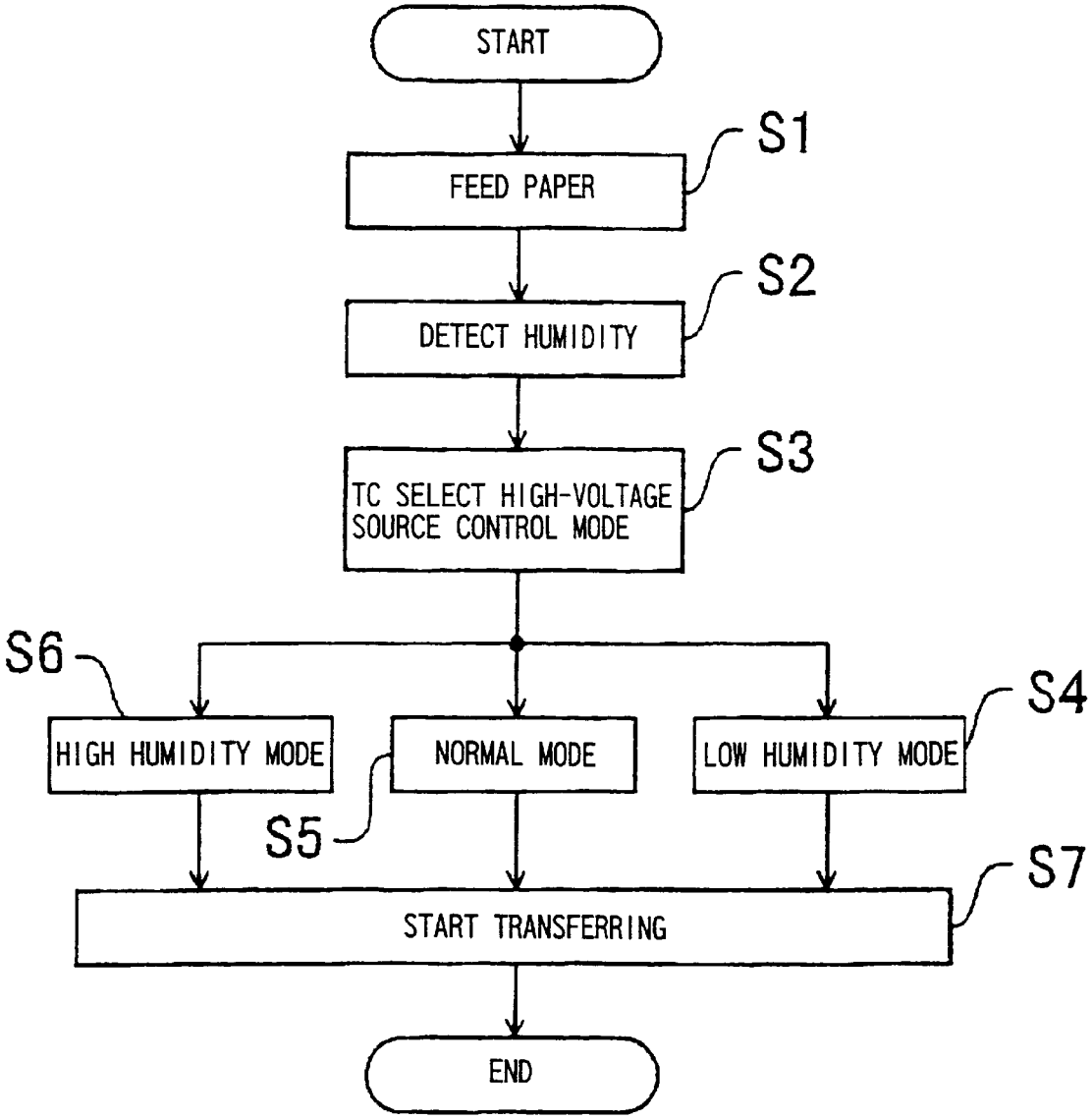
FIG. 8 is an operation flowchart for controlling a transfer output using the circuit structure shown in FIG. 7.

FIG. 8 is a flowchart showing a control operation of the transfer output in the case of providing humidity sensing device 15 and the comparators 14*a* and 14*b* as shown in FIG. 7.

Specifically, when a paper feeder, which is not shown in the drawings, starts to feed the recording material P (Step S1), the CPU 13 detects the humidity on the basis of comparative signals inputted from the comparators 14*a* and 14*b* (Step S2), and selects a suitable control mode to control the transfer high-voltage source 51 on the basis of the detected results (Step S3).

More specifically, when an input from the first comparator 14*a* is signal L and an input from the second comparator 14*b* is signal L, the CPU 13 judges the humidity to be 25% or lower and selects the low humidity mode (Step S4), and starts the transfer process (Step S7).

Alternatively, when the input from the first comparator 14*a* is signal H and the input from the second comparator 14*b* is signal L, the CPU 13 judges the humidity to be within the range between 25% and 65% and selects the normal mode (Step S5), and starts the transfer process (Step S7).

Otherwise, when the input from the first comparator 14*a* is signal H and the input from the second comparator 14*b* is signal H, the CPU 13 judges the humidity to be 65% or higher and selects the high humidity mode (Step S6) ,and starts the transfer process (Step S7).

Although the above concrete example combines two comparators 14, a combination of three or more comparators enables a finer control with the control range divided into narrower ranges.

Third embodiment

One of major factors greatly effecting the transfer performance other than environmental conditions is the thickness of the recording material P. A third embodiment proposes a method for constantly maintaining an optimal transfer performance by sensing and judging the thickness of the recording material P.

In the image forming apparatus shown in FIG. 1, a paper thickness sensing device is provided. On the basis of the results sensed by this paper thickness sensing device, the transfer current application method in the raising process of the transfer current is controlled.

Figure 9:
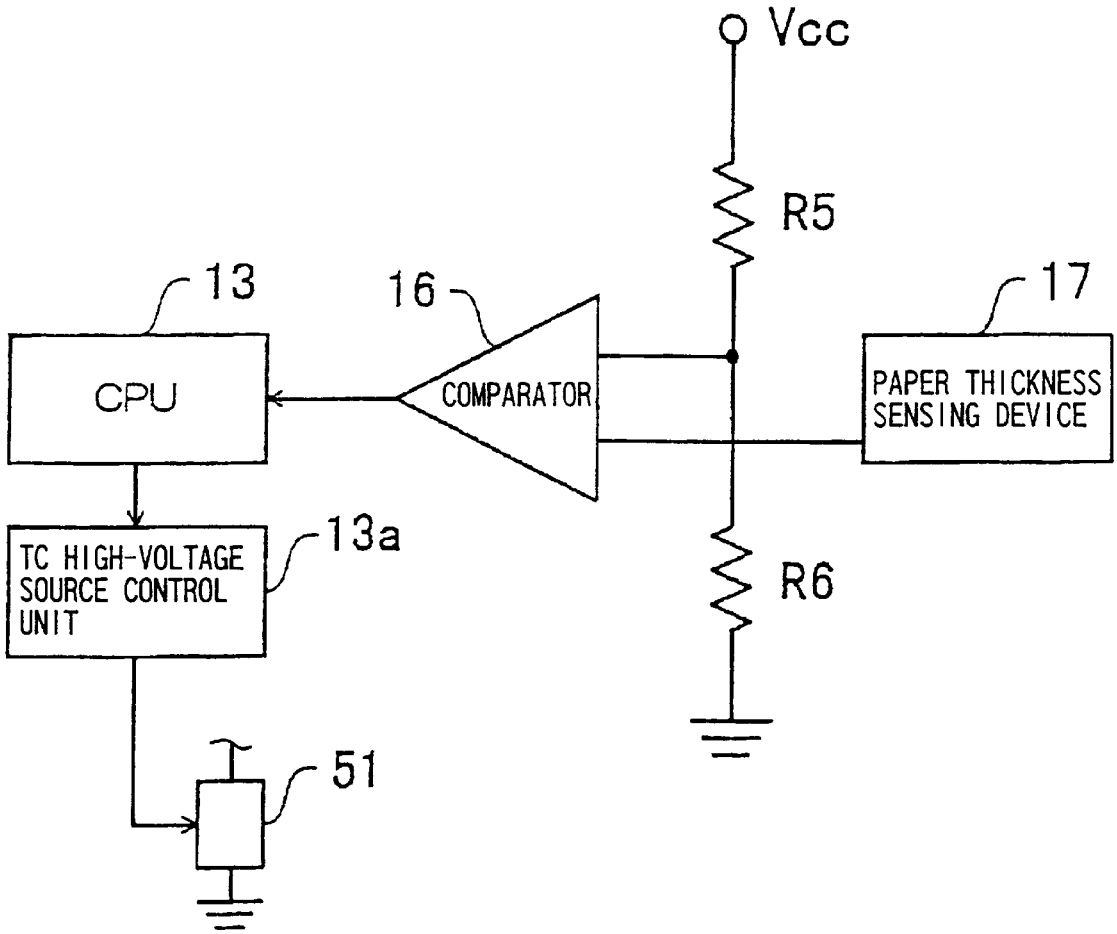
FIG. 9 is a basic circuit block diagram for realizing a control method of a third embodiment.

FIG. 9 is a basic circuit block diagram for realizing a control method according to the third embodiment.

Specifically, an output terminal of a paper thickness sensing device 17 is connected to one of input terminals of a comparator 16. To the other input terminal of the comparator 16, a comparative reference voltage Vref resulting from division of a source voltage Vcc by resistors R5 and R6 is applied. The output of the comparator 16 is inputted to CPU 13. The paper thickness sensing device 17 transforms the sensed thickness into a voltage Vn and inputs it to the comparator 16.

The comparator 16 compares both voltage values with each other. When the paper thickness sensed by the paper thickness sensing device 17 is thinner than a predetermined thickness, namely Vref>Vn, the comparator 16 outputs a signal L, while when the paper thickness sensed by the paper thickness sensing device 17 is not thinner than the predetermined thickness, namely Vref≦Vn, the comparator 16 outputs a signal H.

The CPU 13 outputs a control signal based on the signal to the TC high-voltage source control unit 13*a* so as to control the transfer output of the transfer high-voltage source 51.

Tables 4 and 5 show the results of the occurrence of the transfer memory and the edge transfer performance by using the current application method shown in FIG. 2C, in which the transfer current is applied in five different ways and in four different ways by altering the durations of the ON time and OFF time in the current raising process while being controlled by sensing the paper thickness of recording material P using the circuit shown in FIG. 9, respectively.

TABLE 4

PAPER THINNER THAN REFERENCE PAPER THICKNESS

| HUMIDITY | TRANSFER CURRENT APPLICATION METHOD USED IN CURRENT RAISING PROCESS | TRANSFER MEMORY | EDGE TRANSFER PERFORMANCE | CURRENT APPLICATION CONTROL SIGNAL (ON/OFF TIME (ms)) ON | OFF | ON | OFF | ON |
|---|---|---|---|---|---|---|---|---|
| 50% | A (CONVENTIONAL METHOD) | ×× | ◎ | FULL APPLICATION | | | 10 | FULL APPLICATION |
| | C | ○ | ◎ | 20 | 20 | FULL APPLICATION | | |
| | D | ◎ | ◎ | 15 | 10 | 5 | | |
| | E | ◎ | ◎ | 15 | 20 | FULL APPLICATION | | |
| | F | ◎ | ○ | 10 | 20 | FULL APPLICATION | | |

TABLE 5

PAPER THICKER THAN REFERENCE PAPER THICKNESS

| HUMIDITY | TRANSFER CURRENT APPLICATION METHOD USED IN CURRENT RAISING PROCESS | TRANSFER MEMORY | EDGE TRANSFER PERFORMANCE | CURRENT APPLICATION CONTROL SIGNAL (ON/OFF TIME (ms)) ON | OFF | ON | OFF | ON |
|---|---|---|---|---|---|---|---|---|
| 50% | A (CONVENTIONAL METHOD) | ×× | ◎ | FULL APPLICATION | | | 10 | FULL APPLICATION |
| | C | ○ | ◎ | 20 | 20 | FULL APPLICATION | | |
| | D | ◎ | ○ | 15 | 10 | 5 | | |
| | E | ◎ | ○ Δ | 15 | 20 | FULL APPLICATION | | |

The relationship between the transfer current application amount and the current raising time is similar to that shown in FIG. 3.

From these results, it is confirmed that in the case of the recording material thinner than the reference paper thickness, a step can be provided when the transfer current application amount is within a range of 30% to 50%.

It is further confirmed that in the case of the recording material thicker than the reference paper thickness, a step is preferably provided when the transfer current application amount is within a range of 40% to 50%.

According to the above results, it is found from the above that favorable results can be obtained by feeding back the paper thickness condition to the CPU 13 using the paper thickness sensing device 17 and controlling the time of the current application control signals using a thick paper mode and a thin paper mode with the reference paper thickness (normal mode) centered.

Figure 10:
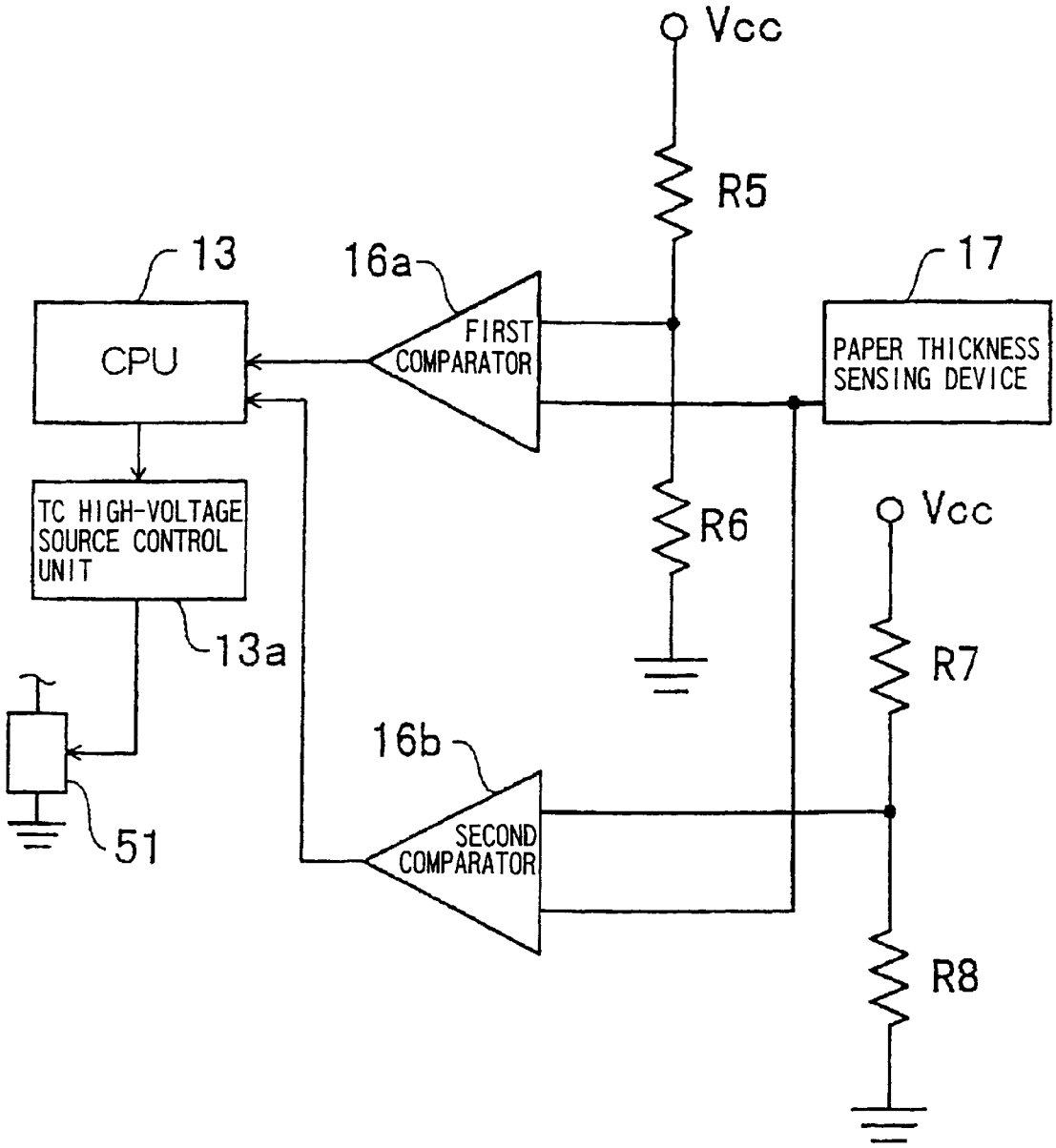
FIG. 10 is a more concrete circuit block diagram for realizing the control method of the third embodiment.

FIG. 10 is a circuit block diagram for applying current application control signals from the TC high-voltage source control unit 13*a* to the transfer device 5 in three different modes (i.e., thick paper mode, normal mode and thin paper mode).

Specifically, an output terminal of the paper thickness sensing device 17 is connected to one of input terminals of a first comparator 16*a* and a second comparators 16*b,* respectively. To the other input terminal of the first comparator 16*a,* a comparative reference voltage Vref1 resulting from division of a source voltage Vcc by resistors R5 and R6 is applied. Similarly, to the other input terminal of the second comparator 16*b,* a comparative reference voltage Vref2 resulting from division of a source voltage Vcc by resistors R7 and R8 is applied. The outputs of these comparators 16*a,* 16*b* are inputted to the CPU 13. The paper thickness sensing device 17 transforms the sensed thickness into a voltage Vn and inputs it to the first and second comparators 16*a* and 16*b,* respectively.

The first comparator 16*a* compares both voltage values with each other. When the paper thickness sensed by the paper thickness sensing device 17 is thinner than a predetermined thickness (lower limit of the reference paper thickness), namely Vref1>Vn, the first comparator 16*a* outputs a signal L, while when the paper thickness sensed by the paper thickness sensing device 17 is not thinner than the predetermined thickness (lower limit of the reference paper thickness), namely Vref1≦Vn, the first comparator 16*a* outputs a signal H. On the other hand, the second comparator 16*b* compares the two inputted voltage values with each other. When the paper thickness sensed by the paper thickness sensing device 17 is thinner than a predetermined thickness (upper limit of the reference paper thickness), namely Vref2>Vn, the second comparator 16*b* outputs a signal L, while when the paper thickness sensed by the paper thickness sensing device 17 is not lower than the predetermined paper thickness (upper limit of the reference paper thickness), namely Vref1≦Vn, the second comparator 16*b* outputs a signal H.

The CPU 13 outputs a control signal based on the inputted signals to the TC high-voltage source control unit 13*a*.

Figure 11:
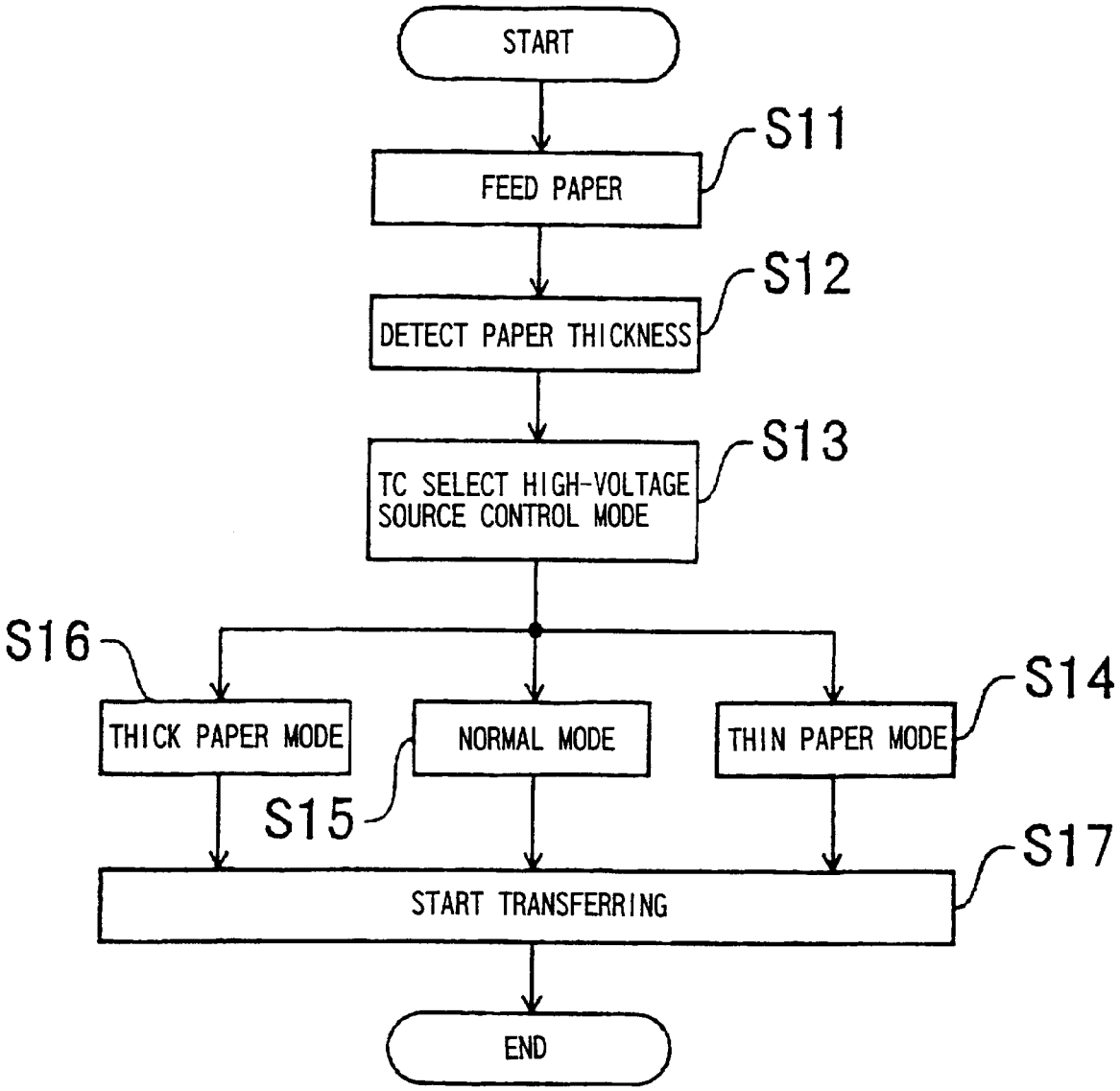
FIG. 11 is an operation flowchart for controlling a transfer output using the circuit structure in FIG. 10.

FIG. 11 is an operation flowchart showing a control operation of the transfer output in the case of providing the paper thickness sensing device 17 and comparators 16*a* and 16*b* as shown in FIG. 10.

Specifically, when paper feeding means, which is not shown in drawings, starts to feed the recording material P (Step S11), the CPU 13 detects the paper thickness on the basis of comparative signals inputted from the comparators 16*a* and 16*b* (Step S12), and selects a suitable control mode to control the transfer high-voltage source 51 on the basis of the detecting results (Step S13).

More specifically, when an input from the first comparator 16*a* is signal L and an input from the second comparator 16*b* is signal L, the CPU 13 judges the recording material to be thin and selects the thin paper mode (Step S14), and starts the transfer process (Step S17).

Alternatively, when the input from the first comparator 16*a* is signal H and the input from the second comparator 16*b* is signal L, the CPU 13 judges the paper thickness to be within the reference thickness range and selects the normal mode (Step S15), and starts the transfer process (Step S17).

Otherwise, when the input from the first comparator 16*a* is signal H and the input from the second comparator 16*b* is signal H, the CPU 13 judges the recording material to be thick and selects the thick paper mode (Step S16), and starts the transfer process (Step S17).

Although in the above embodiment are combined two comparators 16, a combination of three or more comparators enables finer control with the control range divided into narrower ranges. Further, much finer control is possible by combining the humidity sensing control in the second embodiment and the paper thickness sensing control in the third embodiment.

Although the above embodiments employ the corona discharge system as the transfer device and a tungsten wire as the electrode, a serrated electrode may be used instead of the tungsten wire electrode. Such a serrated electrode 2*a* is shown in FIG. 1*a,* for example. When such a serrated electrode is used, the amount of generated ozone can be reduced and environment-friendly transfer device can be provided in comparison with the case of using the wire electrode.

Further, the use of a high-voltage transformer as the transfer device to perform constant-current control makes it possible to facilitate the stepwise control.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. An image forming apparatus comprising:

an image carrier;

an electrostatic charging device for causing the image carrier to be electrostatically charged;

an exposure device for forming an electrostatic latent image by exposing the electrostatically charged image carrier to light;

a developing device for developing the formed electrostatic latent image with toner;

a transfer device for transferring a toner image formed by development, to a recording material which is in contact with a peripheral surface of the image carrier, by generating the corona discharge directed to the recording material; and a current controller for controlling a transfer current for corona discharge applied to the transfer device so as to be applied stepwise to the transfer device at a time of start-up of the transfer, wherein the current controller controls the transfer current so as to be applied stepwise, by adjusting on and off time durations of a current applying control signal composed of on and off signals.

2. The image forming apparatus of claim 1, wherein the current controller performs the stepwise application of the transfer current to the transfer device in a process for raising a current value to a predetermined level at which a constant-current control is possible and a number of transfer current steps is one or two.

3. The image forming apparatus of claim 1, wherein the current controller performs the stepwise application of the transfer current to the transfer device in a process for raising a current value to a predetermined level at which a constant-current control is possible, and a duration of the process is 100 to 120 ms.

4. The image forming apparatus of claim 1, wherein the current controller performs the stepwise application of the transfer current to the transfer device in a process for raising a current value to a predetermined level at which a constant-current control is possible, and the stepwise transfer current application is performed when a current value is within a range of 40% to 50% of the predetermined level.

5. The image forming apparatus of claim 1, further comprising:

a humidity sensor for sensing a humidity of an operation environment, wherein the current controller varies stepwise applying conditions of the transfer current based on a result sensed by the humidity sensor.

6. The image forming apparatus of claim 1, further comprising:

a thickness sensor for sensing a thickness of the recording material, wherein the current controller varies stepwise applying conditions of the transfer current based on a result sensed by the thickness sensor.

7. The image forming apparatus of claim 1, wherein the transfer device is provided with a corona discharge electrode composed of a wire electrode.

8. An image forming apparatus comprising:

an image carrier;

an electrostatic charging device for causing the image carrier to be electrostatically charged;

an exposure device for forming an electrostatic latent image by exposing the electrostatically charged image carrier to light;

a developing device for developing the formed electrostatic latent image with toner;

a transfer device for transferring a toner image formed by development, to a recording material which is in contact with a peripheral surface of the image carrier, by generating the corona discharge directed to the recording material; and a current controller for controlling a transfer current for corona discharge applied to the transfer device so as to be applied stepwise to the transfer device at a time of start-up of the transfer, wherein the current controller controls the transfer current so as to be applied stepwise by using a switching circuit system to make a two or more step adjustment of an amount and a time of application of the transfer current to the transfer device.

* * * * *